US008997816B2

(12) United States Patent
Malik, Jr. et al.

(10) Patent No.: US 8,997,816 B2
(45) Date of Patent: Apr. 7, 2015

(54) TAPE DISPENSER

(75) Inventors: Richard S. Malik, Jr., Rossford, OH (US); Thomas Truman, Toledo, OH (US)

(73) Assignee: First Solar, Inc, Perrysburg, OH (US)

( * ) Notice: Subject to any disclaimer, the term of this patent is extended or adjusted under 35 U.S.C. 154(b) by 0 days.

(21) Appl. No.: 13/220,023

(22) Filed: Aug. 29, 2011

(65) Prior Publication Data

US 2012/0048448 A1 Mar. 1, 2012

Related U.S. Application Data

(60) Provisional application No. 61/378,759, filed on Aug. 31, 2010.

(51) Int. Cl.

| | |
|---|---|
| ***B65C 9/40*** | (2006.01) |
| ***B65H 26/00*** | (2006.01) |
| ***G05G 15/00*** | (2006.01) |
| ***B65H 37/00*** | (2006.01) |

(52) U.S. Cl.

CPC ..... *B65H 37/002* (2013.01)

(58) Field of Classification Search

USPC ..... 156/64, 378, 99, 104, 106, 109, 351, 156/352, 361–364, 459, 543, 574, 576, 577

See application file for complete search history.

(56) References Cited

U.S. PATENT DOCUMENTS

| | | | | |
|---|---|---|---|---|
| 4,696,707 | A * | 9/1987 | Lewis et al. | 156/64 |
| 5,312,501 | A | 5/1994 | Gruber et al. | |
| 5,450,116 | A | 9/1995 | Weiselfish et al. | |
| 5,938,097 | A | 8/1999 | Lam | |
| 6,026,883 | A * | 2/2000 | Hegerhorst et al. | 156/441 |
| 6,668,892 | B2 * | 12/2003 | Vasilakes et al. | 156/387 |
| 7,401,631 | B2 | 7/2008 | Jacot et al. | |
| 2007/0107825 | A1 * | 5/2007 | Bredl et al. | 156/64 |
| 2009/0188628 | A1 | 7/2009 | Kasahara et al. | |
| 2010/0131108 | A1 | 5/2010 | Meyer | |
| 2010/0212725 | A1 | 8/2010 | Barth et al. | |

FOREIGN PATENT DOCUMENTS

| | | | | |
|---|---|---|---|---|
| EP | 0 640 545 | A1 | 3/1995 | |
| EP | 640545 | A1 * | 3/1995 | B65H 21/00 |
| JP | 2001122507 | A * | 5/2001 | B65H 35/07 |
| WO | WO 2006/115094 | A1 | 11/2006 | |

OTHER PUBLICATIONS

Drury, Bill. The Control Techniques Drives and Controls Handbook. © 2001 The Institution of Electrical Engineers.*
T&W Converters, Inc., Website, Glendale, CA, USA.

* cited by examiner

*Primary Examiner* — John Goff
*Assistant Examiner* — Carson Gross
(74) *Attorney, Agent, or Firm* — Dickstein Shapiro LLP

(57) ABSTRACT

A tape dispenser includes a torque controller and a take-up cassette.

23 Claims, 4 Drawing Sheets

TAPE DISPENSER

CLAIM OF PRIORITY

This application claims priority under 35 U.S.C. §119(e) to U.S. Provisional Patent Application Ser. No. 61/378,759 filed Aug. 31, 2010, which is hereby incorporated by reference in its entirety.

TECHNICAL FIELD

The present invention relates to tape dispensers for photovoltaic modules and methods of dispensing tape.

BACKGROUND

A photovoltaic module may include an optically transparent front substrate and a protective back substrate. The module may also include a plurality of layers formed between the front and back substrates thereby enabling the module to convert solar radiation to electricity. During manufacturing of the module, tape may be applied to a portion of the module. The tape may be a double-sided tape having a backing layer. Existing apparatuses for dispensing tape can experience complications resulting from poor control over the tape dispensing process and poor control over collecting the backing layer.

DETAILED DESCRIPTION

Figure 1:
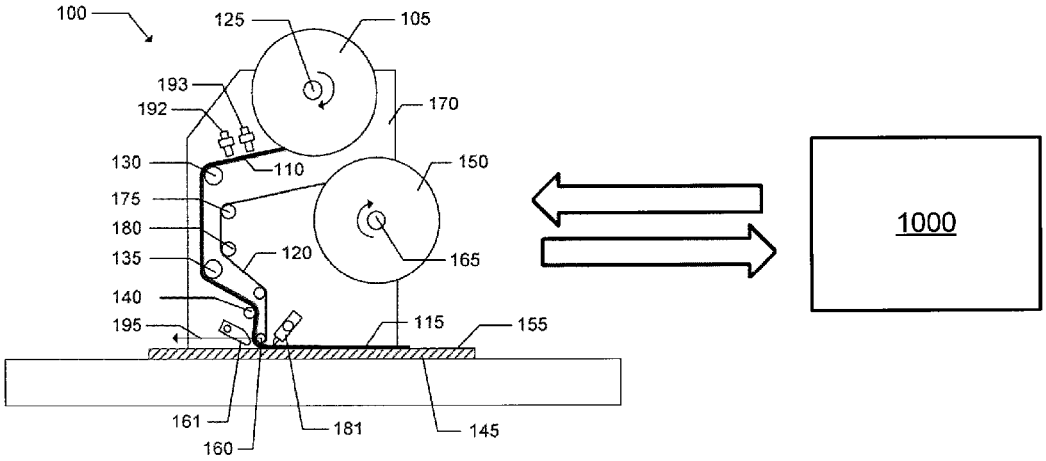
FIG. 1 is a side view of an apparatus for dispensing tape.

A photovoltaic module can include a plurality of photovoltaic devices, each of which can include multiple layers created on a substrate (or superstrate). For example, a photovoltaic device can include a barrier layer, a transparent conductive oxide (TCO) layer, a buffer layer, and a semiconductor layer formed in a stack on a substrate. Each layer may in turn include more than one layer or film. For example, the semiconductor layer can include a first film including a semiconductor window layer, such as a cadmium sulfide layer, formed on the buffer layer and a second film including a semiconductor absorber layer, such as a cadmium telluride layer formed on the semiconductor window layer. Additionally, each layer can cover all or a portion of the device and/or all or a portion of the layer or substrate underlying the layer. For example, a "layer" can include any amount of any material that contacts all or a portion of a surface.

In addition to the aforementioned layers, the photovoltaic module may include a first section of conductive tape and a second section of conductive tape. The first and second sections of conductive tape may serve as positive and negative leads for the module. A section of tape may be applied between the first and second sections of conductive tape and may serve as an insulating barrier between the sections. While the tape may be positioned manually, it is far more efficient to use an automated tape dispenser. Many tape dispensers fail to produce consistent results and are unable to achieve precision placement of the tape. For example, tape dispensers may allow the tape to drift during the dispensing process thereby resulting in improper alignment of the tape relative to the first and second sections of conductive tape. Misalignment of the tape can result in electrical shorting between the first and second conductive portions, and is therefore undesirable. Tape dispensers may also suffer from issues such as unraveling and jamming. To remedy shortcomings of existing tape dispensers, an improved tape dispenser and an improved method of manufacturing photovoltaic modules were devised and are set forth herein.

In one aspect, a tape dispenser can include a supply spindle configured to receive a supply tape roll comprising a tape liner and a rewind spindle configured to receive tape liner from the supply tape roll. The tape dispenser can include a tape liner path including a plurality of rollers positioned between the supply spindle and the rewind spindle. The tape path can be configured to guide a tape liner from the supply spindle to the rewind spindle. The tape dispenser can include a motor connected to the rewind spindle and configured to apply tension to a tape liner positioned on the tape liner path. The tape dispenser can include a tension sensor configured to detect a tension on a tape liner and to adjust the torque output of the motor based on the tension on a tape liner detected by the tension sensor.

The tension sensor can include a roll diameter sensor configured to detect at least one of a tape roll diameter and tape liner roll diameter and calculate a tension on a tape liner based on the roll diameter. The tension sensor can adjust the torque output of the motor by controlling the power input to the motor based on the roll diameter. The tape dispenser can include a second motor connected to the supply spindle, wherein the second motor torque output can be controlled by the tension sensor. At least a portion of the tape liner path is positioned within a tape applicator head configured to apply a tape separated from a tape liner to a surface.

In another aspect, a tape dispensing system may include a body, a supply cassette rotatably mounted to the body, a take-up cassette rotatably mounted to the body, and an application roller rotatably mounted to the body. The tape may be routed from the supply cassette to the application roller. The tape may have a backing layer, and the backing layer may be routed from the application roller to the take-up cassette. A first torque controller may be connected to the supply cassette. The first torque controller may include a first torque sensor. A second torque controller may be connected to the take-up cassette. The second torque controller may include a second torque sensor.

The application roller may be a driven roller. The application roller may have a diameter ranging from about 2 mm to about 20 mm. The system may include a gripper proximate to the application roller. The gripper may be configured to capture the tape against the application roller. The system may include a pre-application roller rotatably mounted to the body. The pre-application roller may have a diameter ranging from about 2 mm to about 20 mm. The pre-application roller may be an idler roller. The system may include a pre-application gripper proximate to the pre-application idler roller. The pre-application gripper may be configured to capture the tape against the pre-application idler roller. The pre-application idler roller may have an axis parallel to a supply cassette axis, and the pre-application idler roller may be intersected by a plane that is normal to the supply cassette axis and includes a midpoint of the supply cassette.

The system may include a post-application idler roller rotatably mounted to the body. The post-application idler roller may have a diameter ranging from about 2 mm to about 20 mm. The post-application roller may be an idler roller. The system may include a post-application gripper proximate to the post-application idler roller. The post-application gripper may be configured to capture the backing layer against the post-application idler roller. The post-application idler roller may have an axis parallel to a take-up cassette axis, and the post-application idler roller may be intersected by a plane that is normal to the take-up cassette axis and includes a midpoint of the take-up cassette. The system may further include a cutter mounted to the body and configured to cut the tape.

In another aspect, a method for applying tape may include supplying tape from a torque controlled supply cassette to an application roller, applying the tape to a surface proximate the roller, and stripping a backing layer from the tape and collecting the backing layer on a torque controlled take-up cassette. The method may include adjusting a resistance torque of the supply cassette based on a diameter of a tape roll on the supply cassette. The resistance torque may decrease as the diameter of the tape roll decreases. The method may include adjusting a torque of the take-up cassette based on a measured torque being applied to the take-up cassette. The torque of the take-up cassette may be increased if the measured torque is lower than a predetermined value. Conversely, the torque of the take-up cassette may be decreased if the measured torque is higher than a predetermined value.

Referring by way of example to FIG. 1, a tape dispenser 100 may be configured to dispense tape 110. For example, the tape dispenser 100 may be configured to dispense tape 110 onto a surface 155, and the surface may be associated with a photovoltaic module 145. The tape 110 may be double-sided tape and may include a primary layer 115 and a backing layer 120. The primary layer 115 may be formed from any suitable material such as an electrical insulating material. The primary layer may have a first surface and a second surface opposite the first surface. The first surface and the second surface may be coated with an adhesive. The backing layer 120 may be a removable layer such as wax paper. Removal of the backing layer 120 may expose adhesive on one of the surfaces of the primary layer 115.

Figure 2:
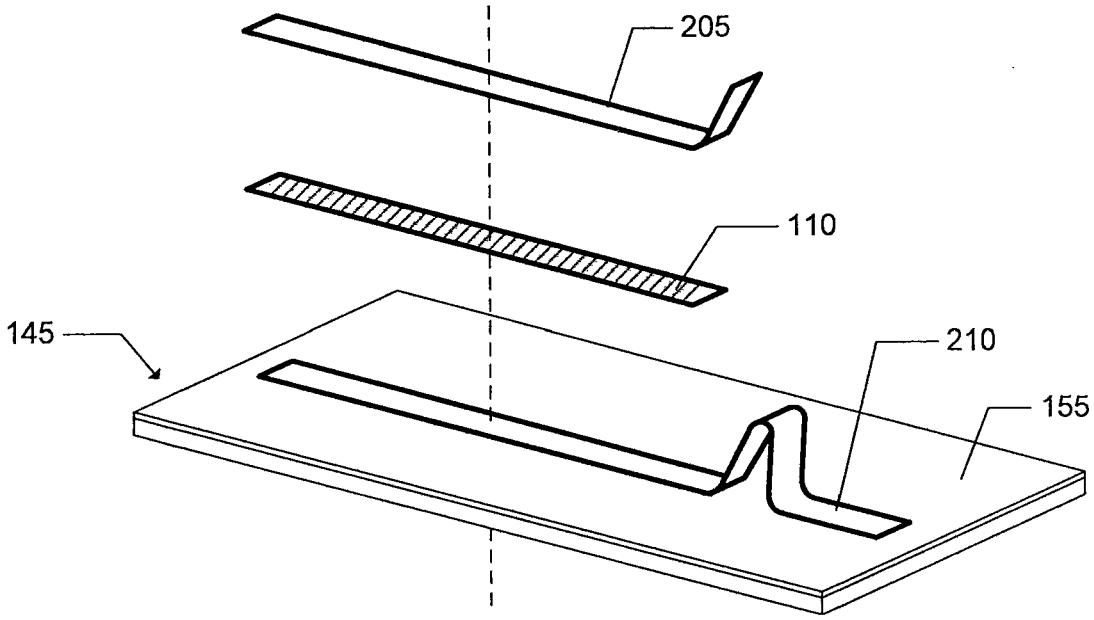
FIG. 2 is an exploded perspective view of a partially assembled photovoltaic module.
Figure 3:
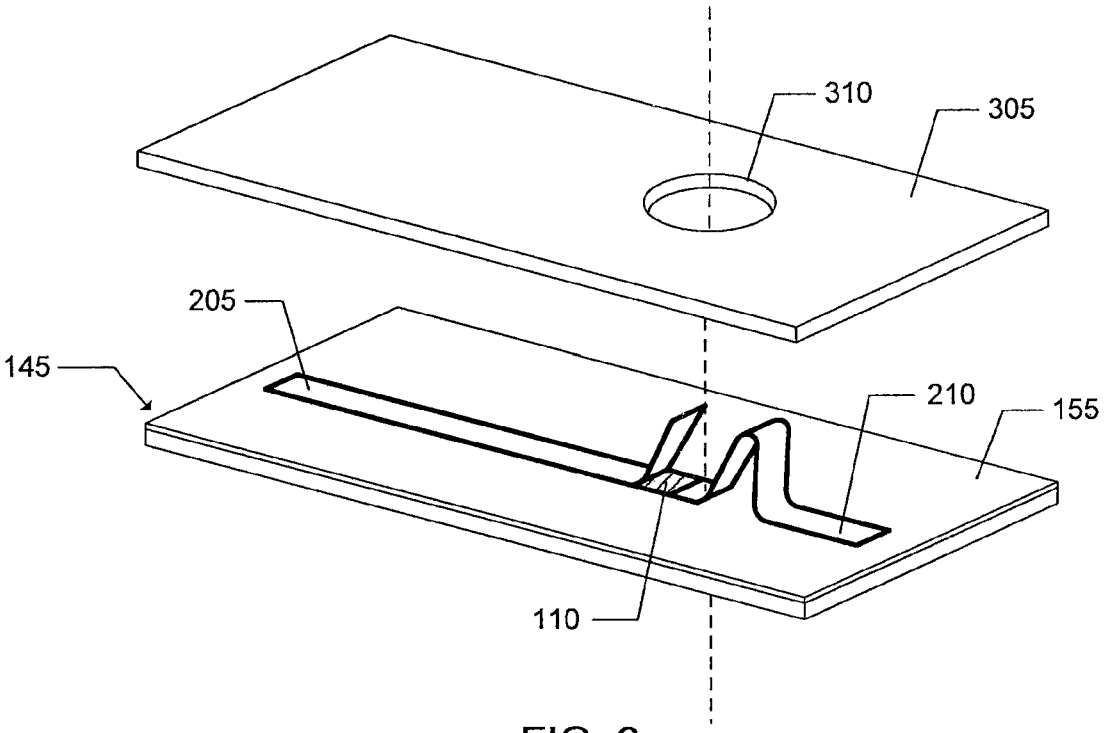
FIG. 3 is an exploded perspective view of a partially assembled photovoltaic module.
Figure 4:
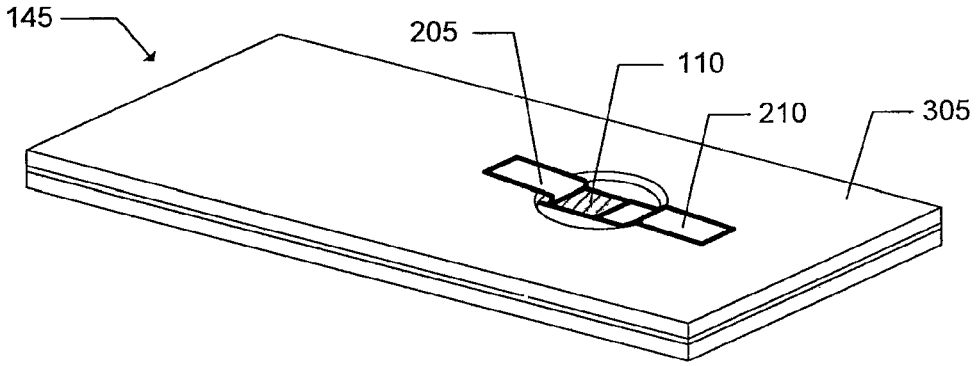
FIG. 4 is a perspective view of a partially assembled photovoltaic module.

As discussed above, the photovoltaic module may include a first section of conductive tape 210 and a second section of conductive tape 205. The first and second sections of conductive tape (205, 210) may serve as positive and negative leads for the module 145. During manufacturing, the tape 110 may be applied between the first and second sections of conductive tape (205, 210) and may serve as an insulating barrier between the sections. For example, when manufacturing a photovoltaic module 145, a first section of conductive tape 210 may be formed adjacent to the surface 155 of the module. The tape 110 may be formed adjacent to the first section of conductive tape 210, and a second section of conductive tape 205 may be formed adjacent to the tape 110. The positioning of the first and second conductive section (205, 210) and the tape 110 is visible in FIG. 2, which depicts an exploded view of a partially assembled module. Once the first and second conductive section (205, 210) and the tape 110 have been formed, a substrate 305 having a hole 310 may be added to the module as shown in the exploded view of FIG. 3. As shown in FIG. 4, the first and second conductive sections (205, 210) may be folded back against the substrate to serve as positive and negative leads for the module 145. A junction box may then be placed over the positive and negative leads, thereby facilitating electrical connection to other electrical components.

The tape 110 may be wound around a cylinder, spool, or other suitable core to form a roll of tape around a supply cassette 105. The supply cassette 105 may be rotatably mounted to the body 170 of the tape dispenser 100. To avoid jamming and to ensure proper placement of the tape 110 on the surface 155, it is desirable to maintain tension within the tape 110. In known apparatuses, tension is maintained with a spring-loaded dancer arm. However, it is desirable to eliminate the dancer arm to enhance performance. The dancer arm may be replaced by a first torque controller installed proximate to the supply cassette 105. The first torque controller may be installed proximate to the first hub 125 and may be capable of adjusting the resistance torque required to rotate the supply cassette. The torque controller may be capable of adjusting the resistance torque required to rotate the supply cassette from about 5 N-cm to about 50 N-cm.

The supply cassette 105 may be mounted to a first hub 125 that is connected to the body 170 of the apparatus 100. The first hub 125 may be a driven hub. For instance, the first hub 125 may include an electric motor capable of providing torque to the first hub 125 during the application process. The torque applied to the first hub 125 may be controlled with a computer 1000. The first hub 125 may include a first torque sensor. Output from the first torque sensor may be delivered to the computer 1000. By providing feedback, the computer 1000 can adjust the torque delivered to the first hub 125 to improve the dispensing process. For instance, if the first torque sensor indicates that too much torque is being applied to the first hub 125, the first hub torque may be reduced to decrease tension in the tape 110, thereby avoiding breaking the tape 110, which could result in jamming. Alternately, if the first torque sensor indicates too little torque is being applied to the first hub 125, the first hub torque may be increased to avoid formation of slack between the supply cassette 105 and application roller 160, which could result in jamming.

As the supply cassette 105 is depleted during the dispensing process, the outer diameter of the tape roll decreases. As a result, less resistance torque is required to oppose rotation of the hub as the mechanical advantage diminishes. Therefore, if tape 110 is being drawn from the roll at a constant force by a driven roller, the resistance torque must be adjusted to avoid the tension on the tape from being too high or too low. For example, if too much resistance torque is applied to the first hub 125, too much tension may be applied to the tape causing it to stretch or break. Conversely, if too little resistance torque is applied to the hub, the tape may become slack thereby resulting in jamming.

It may be desirable to adjust the torque applied to the hub 125 over the course of the dispensing process to account for the changing tape roll diameter. For instance, the first torque controller may reduce the resistance torque applied to the hub as the roll diameter decreases over time. A first resistance torque may be applied at a first point in time ($t_1$), and a second resistance torque may be applied at a second point in time ($t_2$), where the first resistance torque is larger than the second resistance torque. In particular, the first resistance torque may range from about 15 N-cm to about 50 N-cm, where $t_1$ corresponds to a tape roll diameter ranging from about 18 cm to about 50 cm. The second resistance torque may range from about 5 N-cm to about 15 N-cm, where $t_2$ corresponds to a tape roll diameter ranging from about 7 cm to about 25 cm. The resistance torque may be adjusted linearly or nonlinearly from $t_1$ to $t_2$. In addition, the resistance torque values may account for material properties of the tape such as tensile strength. For example, the resistance torque may be limited to avoid reaching or exceeding the tape's tensile strength.

The tape 110 may be routed from the supply cassette 105 through one or more pre-application rollers (e.g. 130, 135, 140). The pre-application rollers may guide the tape 110 from the supply cassette 105 to an application roller 160. To ensure the tape 110 does not deviate laterally from its target dispensing location, the pre-application rollers (e.g. 130, 135, 140) may have uniform diameters or non-uniform diameters. The diameters of the rollers may range from about 2 mm to about 20 mm. Preferably, the diameter of the rollers may range from about 4 mm to about 10 mm. By incorporating rollers having equal diameters, tape 110 alignment may be improved. In turn, product quality may be improved, and the dispensing rate may be increased.

The tape 110 may be routed from the one or more pre-application rollers (e.g. 130, 135, 140) to an application roller 160 where the primary layer 115 of the tape 110 is dispensed onto the surface 155 of the photovoltaic module 145. The application roller 160 may be rotatably mounted to the body 170 of the apparatus. The application roller 160 may be a driven roller. Alternately, the application 160 may be a non-driven roller, and tape dispensing may result from relative motion between the application roller 160 and the module 145. For instance, the application roller 160 may move relative to the module 145, as shown with an arrow 195 in FIG. 1. Relative movement may result from independent movement of the application roller 160 or by movement of the apparatus body 170 to which the application roller 160 is connected. For example, the apparatus 100 may be mounted on a rail system and include a drive system which allows it to move axially. As a result, the application roller 160 may traverse the photovoltaic module 145 and apply tape 110 to its surface 155.

The application roller 160 may provide a downward force against the surface 155 of the module 145, and the tape 110 may be pressed between the application roller 160 and the surface 155 of the module 145. As the application roller moves relative to the module 145, the tape 110 may be drawn from the supply roller 105 and deposited on the surface 155 of the module 145. To ensure adequate adhesion against the surface 155 of the module 145, the apparatus 100 may include a spring attached to the application roller 160 to provide downward pressure against the tape 110 and the surface 155. Alternately, any suitable technique for displacing the application roller 160 in a downward direction may be used such as pneumatic or hydraulic pressure. The diameter of the application roller 160 may range from about 2 mm to about 20 mm. Preferably, the diameter of the application roller 160 may range from about 4 mm to about 10 mm.

As the primary layer 115 of the tape 110 is dispensed onto the surface 155 of the photovoltaic module 145, the backing layer 120 may be stripped from the tape 110 and routed to a take-up cassette 150. The purpose of the take-up cassette 150 may include collecting the backing layer 120 during the process to avoid complications such as jamming. The take-up cassette 150 may be rotatably mounted to the body 170 of the apparatus. For example, the take-up cassette 150 may be mounted to a second hub 165 that is connected to the body 170 of the apparatus 100. The second hub 165 may be a driven hub. For instance, the second hub 165 may include an electric motor capable of providing torque to the second hub and collecting the backing layer 120 during the application process. The torque of the second hub 165 may be controlled with a computer 1000. The second hub 165 may include a torque sensor. Output from the torque sensor may be delivered to the computer 1000. By providing feedback, the computer 1000 can adjust the torque delivered to the second hub 165 to improve the collection process. For instance, if the torque sensor indicates that too much torque is being applied to the second hub 165, the second hub torque may be reduced to decrease tension on the backing layer 120, thereby avoiding breaking the backing layer 120 which could result in jamming. Alternately, if the torque sensor indicates too little torque is being applied to the second hub 165, the second hub torque may be increased to avoid slack in the backing layer 120 which may cause complications such as jamming.

The apparatus 100 may include one or more post-application rollers (e.g. 175, 180). The post-application rollers (e.g. 175, 180) may guide the backing layer 120 from the application roller 160 to the take-up cassette 150. The post-application rollers (e.g. 175, 180) may have uniform diameters or non-uniform diameters. The diameters of the post-application rollers may range from about 2 mm to about 20 mm. Preferably, the diameter of the post-application rollers may range from about 4 mm to about 10 mm.

The apparatus 100 may contain one or more driven rollers and one or more non-driven idler rollers. The driven rollers may receive a torque input from an electric motor or pulley, whereas the non-driven idler rollers may not. The pre-application rollers (e.g. 130, 135, 140) may include non-driven idler rollers that rotate freely. Similarly, the post-application rollers (e.g. 175, 180) may include non-driven idler rollers that rotate freely. The application roller 160 may be a driven roller capable of drawing the tape 110 from the supply cassette 105. The outer surfaces of the non-driven rollers (e.g. 130, 135, 140) may be smooth to avoid damaging the tape, whereas the surface of the driven roller (e.g. 160) may include a high friction material, such as a rubber compound, to grip the tape. During the application process, a constant torque input may be provided to the driven roller. Alternately, a dynamic torque input may be provided to the driven roller. For example, the torque input may ramp up from a low value at the start of the application process to avoid damaging the tape.

The apparatus 100 may include a gripper 161. The gripper may be located proximate to a roller and may be configured to capture the tape against the roller when the process stops. For instance, the computer 1000 may actuate the gripper 161 upon stopping the dispensing process. As a result, the gripper 161 may prevent the tape 110 from unraveling and causing complications when the process restarts. The apparatus 100 may include more than one gripper, and the grippers may be located at several locations. For example, the apparatus may include one or more grippers located proximate to the application roller 160, the pre-application roller (e.g. 130, 135, 140), or the post-application rollers (e.g. 175, 180).

Figure 5:
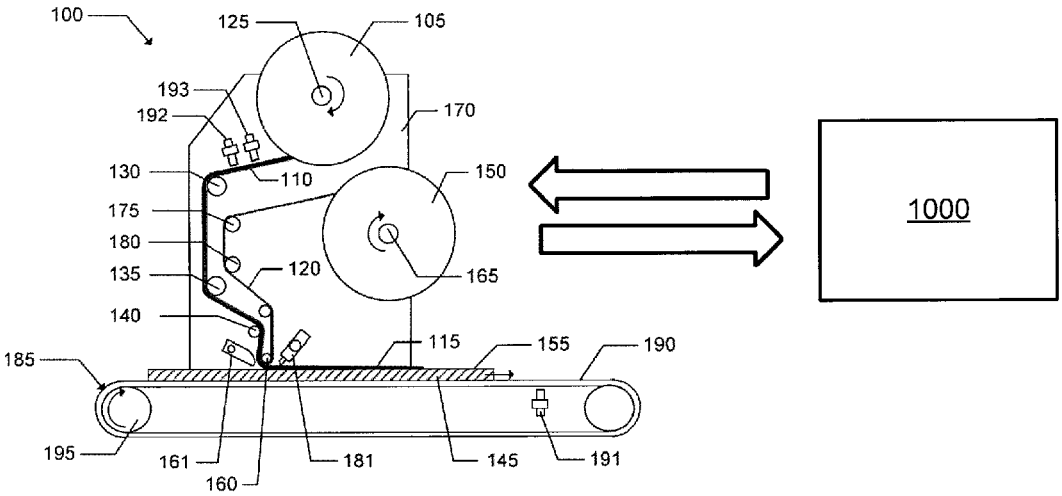
FIG. 5 is a side view of an apparatus for dispensing tape.

Although FIG. 1 depicts a dynamic application roller 160 and a stationary photovoltaic module 145, this is not limiting. For instance, during manufacturing, the application roller 160 and the photovoltaic module 145 may move relative to each other, or the application roller 160 may remain stationary and the module 145 may move relative to application roller 160. As shown in FIG. 5, the tape dispenser 100 may be positioned near, or connected to, a conveyor system 185. The conveyor system 185 may include a conveyor surface 190 and a drive mechanism 195 for propelling the conveyor surface 190. The drive mechanism 195 may include, for example, an electric motor and gear assembly capable of transmitting motion to the conveyor surface 190. The conveyor surface 190 may include a belt, roller, cart, trolley, chain, or screw to move the photovoltaic module 145 over a fixed path. Alternately, any other suitable conveyor surface may be used. A conveyor speed sensor 191 may monitor the speed of the conveyor surface 190. During manufacturing, the photovoltaic module 145 may be loaded onto the conveyor surface 190, and the drive mechanism 195 may be activated. The drive mechanism 195 may cause the conveyor surface 190 to move at a uniform rate in a linear direction. The photovoltaic module 145 may ride on the conveyor surface 190 and pass beneath the application roller 160, and the application roller 160 may dispense tape onto the surface 155 of the photovoltaic module 145.

The apparatus may include a sensor 193 to detect the presence of tape 110. The sensor may be any suitable sensor such as, for example, a proximity sensor or a photoeye. The sensor may be configured to detect the presence of tape 110 and provide a signal to the computer 1000. If the tape 110 breaks, or if the supply cassette 105 is depleted of tape 110, the sensor 193 may no longer detect the presence of tape. As a result, the signal being conveyed from the sensor 193 to the computer 1000 will change. The computer 1000 may respond to the change in signal by, for example, stopping the dispensing process. By stopping the process, the apparatus may avoid producing scrap modules that require rework.

The rate at which the tape 110 is dispensed may be monitored by a speed sensor 192. The speed sensor 192 may be connected to the body 170 of the tape dispenser 100. The speed sensor 192 may monitor the dispensing rate by monitoring the linear speed of the tape as it passes the sensor 192. Alternately, the speed sensor 192 may monitor the rotational speed of one of the rollers. By multiplying the rotational speed of the roller by the circumference of the roller, the dispensing speed can be calculated. By monitoring the dispensing rate, depletion of the supply cassette 105 can be determined and the process can be suspended at an appropriate time to allow the depleted supply cassette to be replaced with a full supply cassette 105. The quantity of tape remaining on the supply cassette 105 may also be monitored with a stroke counter.

To facilitate real-time calculation and monitoring of the dispensing rate, the output of the speed sensor 192 may be delivered to the computer 1000. To ensure the tape 110 is being dispensed in the correct position on the surface 155 of the photovoltaic module 145, the tape dispenser 100 may include a machine vision system (not shown) which monitors the position of the tape in a direction normal to the direction of conveyor movement. The vision system may include a Charge Coupled Device (CCD) camera and image processing software. The computer 1000 may be configured to simultaneously receive and process signals from multiple inputs such as, for example, the speed sensor 192, conveyor speed sensor 191, and vision system. The computer 1000 may include a data acquisition board capable of converting analog signals to digital signals. The computer 1000 may monitor, record, and store signal data in a database.

The computer 1000 may include a software program that permits execution of one or more manufacturing processes. For instance, the software may enable application of tape with little or no manual input. A user may place a partially completed photovoltaic module 145 onto the conveyor surface 190 and initiate a program which automatically applies tape 110 as defined in the manufacturing process. The software program may enable display of a graphical user interface (GUI) on a monitor associated with the computer 1000. The GUI may allow a user to input target manufacturing parameters such as conveyor speed, dispensing rate, resistance torques. The GUI may display data acquired from the sensors in real-time while manufacturing is in progress. In addition, the GUI may allow the user to recall test data from the database and create, display, and print charts and graphs generated from the stored data.

The computer 1000 may continuously monitor signals and make adjustments to the manufacturing process based on the signals. For instance, the computer 1000 may receive and compare the conveyor speed to the dispensing rate. If the goal is to apply tape 110 adjacent to the passing photovoltaic module 145, the dispensing rate and conveyor speed should be equal. But if signals received from the sensors (e.g. 191, 192) indicate the speeds are not equal, the computer 1000 may adjust parameters to bring the process within conformance. For instance, based upon feedback received from the sensors, the computer 1000 may adjust the conveyor speed to match the dispensing rate. To accomplish this, the computer 1000 may calculate the conveyor speed based on a signal received from the conveyor speed sensor 191, and the computer 1000 may calculate the dispensing rate based on a signal received from the tape speed sensor 192. Next, the computer 1000 may compare the actual speeds to target speeds defined within the GUI or software code. If the speeds do not match, the computer 1000 may adjust the speeds accordingly. For example, if the tape dispensing rate is less than the target dispensing rate, the computer 1000 may increase the rotational rate of a driven roller (e.g. 160). Similarly, if the conveyor speed is greater than the target conveyor speed, the computer 1000 may decrease the rotational rate of the drive mechanism 195 of the conveyor. To ensure adequate control, the computer 1000 may be configured to continuously compare actual parameters to target parameter during the manufacturing process. Alternately, the computer 1000 may be configured to compare parameters at predefined intervals. For instance, the computer 1000 may compare parameters every 10 milliseconds.

The apparatus may include a cutter 181. The cutter 181 may be pivotally mounted to the body 170 of the tape dispenser 100. The cutter may be attached to a third hub. By rotating the third hub, the cutter may be brought into contact with the tape 110. If sufficient torque is applied to the third hub, the cutter 181 may shear the tape 110. Alternately, any other suitable means of actuating the cutting blade 181 may be employed such as moving the cutter linearly up and down to facilitate cutting. During a manufacturing process, the cutter 181 may be activated after the proper amount of ape 110 has been dispensed. For instance, based on input parameters, sensor signals, and software code, the computer 1000 may detect when the proper amount of tape 110 has been dispensed. At this moment, the computer 1000 may actuate the cutter 181, thereby severing the tape 110.

Details of one or more embodiments are set forth in the accompanying drawings and description. Other features, objects, and advantages will be apparent from the description, drawings, and claims. Although a number of embodiments of the invention have been described, it will be understood that various modifications may be made without departing from the spirit and scope of the invention. It should also be understood that the appended drawings are not necessarily to scale, presenting a somewhat simplified representation of various features and basic principles of the invention.

What is claimed is:

1. A tape dispenser comprising:

a supply spindle configured to receive a supply tape roll comprising an insulating tape and a tape liner;

a rewind spindle configured to receive the tape liner from the supply tape roll;

a tape liner path comprising a plurality of rollers positioned between the supply spindle and the rewind spindle and configured to guide the tape liner from the supply spindle to the rewind spindle, the plurality of rollers comprising at least one application roller configured to apply the insulating tape to a conductive surface;

at least one gripper configured to move, when tape dispensing ceases, and capture the insulating tape against at least one of the rollers to prevent unraveling of the insulating tape;

a rewind spindle motor connected to the rewind spindle, the rewind spindle motor having a first power input;

a rewind spindle torque controller comprising a tape liner diameter sensor, the first power input adjustable by the rewind spindle torque controller, and the rewind spindle torque controller being configured to control torque based on a predetermined value;

a supply spindle motor connected to the supply spindle, the supply spindle motor having a second power input;

a supply spindle torque controller comprising a supply roll diameter sensor, the second power input adjustable by the supply spindle torque controller; and a computer configured to adjust a rotational rate of the at least one application roller based at least in part on a target dispensing rate.

2. The tape dispenser of claim 1, further comprising:

a first speed sensor configured to detect a speed of a conveyor surface supporting the conductive surface; and a second speed sensor configured to detect a speed of the insulating tape and the tape liner, wherein the computer adjusts the rotational rate of the at least one application roller based on input from the first and second speed sensors, and wherein each torque controller is configured to:

detect a tape diameter; and calculate a tape tension based on the tape diameter.

3. The tape dispenser of claim 2, wherein each torque controller adjusts power input of a motor based on the tape diameter.

4. The tape dispenser of claim 1, wherein the conductive surface comprises an electrical connection.

5. The tape dispenser of claim 1, wherein at least a portion of the tape liner path is positioned within a tape applicator head configured to apply a tape separated from a tape liner to a surface, the tape dispenser further comprising:

a post-application cutter; and a pre-application tape detection sensor configured to detect the presence of tape.

6. A tape dispensing system comprising:

a body;

a supply cassette rotatably mounted to the body;

a take-up cassette rotatably mounted to the body;

an applicator rotatably mounted to the body for applying an insulating tape comprising a backing layer in a first direction, wherein the insulating tape is routed from the supply cassette to the applicator, wherein the backing layer is routed from the applicator to the take-up cassette, and wherein the applicator is configured to apply the insulating tape separated from the backing layer to a conductive surface in a first direction;

at least one gripper configured to move, when tape dispensing ceases, and capture the insulating tape against a roller rotatably mounted to the body to prevent unraveling of the insulating tape;

a take-up cassette motor connected to the take-up cassette, the take-up cassette motor having a first power input;

a take-up cassette torque controller comprising a backing layer diameter sensor, the first power input adjustable by the take-up cassette torque controller, the take-up cassette torque controller being configured to control torque based on a predetermined value;

a supply cassette motor connected to the supply cassette, the supply cassette motor having a second power input;

a supply cassette torque controller comprising a supply roll diameter sensor, the second power input adjustable by the supply cassette torque controller;

a vision system configured to monitor, in a direction normal to the first direction, a position of the insulating tape applied to the conductive surface; and a computer configured to adjust a rotational rate of the applicator based at least in part on a target dispensing rate.

7. The system of claim 6 further comprising:

a pre-application tape detection sensor configured to detect the presence of tape, wherein the applicator is movable relative to the conductive surface;

a first speed sensor configured to detect a speed of a conveyor surface supporting the conductive surface; and a second speed sensor configured to detect a speed of the insulating tape, wherein the computer adjusts the rotational rate of the applicator based on input from the first and second speed sensors.

8. The system of claim 6, wherein the conductive surface comprises an electrical connection.

9. The system of claim 6, wherein the applicator is a driven roller.

10. The system of claim 6, wherein the applicator has a diameter ranging from about 2 mm to about 20 mm.

11. The system of claim 6, wherein the at least one gripper is located proximate to the applicator.

12. The system of claim 6, further comprising a pre-application roller rotatably mounted to the body.

13. The system of claim 12, wherein the pre-application roller has a diameter ranging from about 2 mm to about 20 mm.

14. The system of claim 12, wherein the pre-application roller is an idler roller.

15. The system of claim 14, wherein the at least one gripper is a pre-application gripper proximate to the pre-application idler roller.

16. The system of claim 14, wherein the pre-application idler roller has an axis parallel to a supply cassette axis, and wherein the pre-application idler roller is intersected by a plane that is normal to the supply cassette axis and includes a midpoint of the supply cassette.

17. The system of claim 6, further comprising a post-application idler roller rotatably mounted to the body.

18. The system of claim 17, wherein the post-application idler roller has a diameter ranging from about 2 mm to about 20 mm.

19. The system of claim 17, wherein the at least one gripper is a post-application gripper proximate to the post-application idler roller.

20. The system of claim 17, wherein the post-application idler roller has an axis parallel to a take-up cassette axis, and wherein the post-application idler roller is intersected by a plane that is normal to the take-up cassette axis and includes a midpoint of the take-up cassette.

21. The system of claim 6, further comprising a post-application cutter mounted to the body and configured to cut the insulating tape.

22. The tape dispenser of claim 1, wherein the rewind spindle torque controller and the supply spindle torque controller are controlled by the computer.

23. The system of claim 6, wherein the take-up cassette torque controller and the supply cassette torque controller are controlled by the computer.

* * * * *